US005738054A

United States Patent [19]

Kim

[11] Patent Number: 5,738,054

[45] Date of Patent: Apr. 14, 1998

[54] ENGINE VALVE HAVING ADJUSTABLE LIFT

[75] Inventor: Gyu-Wan Kim, Seoul, Rep. of Korea

[73] Assignee: Hyundai Motor Company, Seoul, Rep. of Korea

[21] Appl. No.: 771,251

[22] Filed: Dec. 20, 1996

[30] Foreign Application Priority Data

Dec. 22, 1995 [KR] Rep. of Korea ..... 95-54834/1995

[51] Int. Cl.[6] ..... F01L 1/10

[52] U.S. Cl. ..... 123/90.15; 123/90.19; 123/90.39; 123/188.2

[58] Field of Search ..... 123/90.1, 90.39, 123/90.12, 90.14, 90.15, 90.19, 188.1, 188.2, 188.3

[56] References Cited

U.S. PATENT DOCUMENTS

| | | | |
|---|---|---|---|
| 3,532,080 | 10/1970 | Saruta | 123/90.19 |
| 4,192,263 | 3/1980 | Kitagawa et al. | 123/90.39 |
| 4,497,307 | 2/1985 | Paar et al. | 123/90.39 |
| 4,723,516 | 2/1988 | Slagley et al. | 123/90.39 |
| 5,351,662 | 10/1994 | Dopson et al. | 123/90.16 |
| 5,531,193 | 7/1996 | Nakamura | 123/90.15 |

*Primary Examiner*—David A. Okonsky

*Attorney, Agent, or Firm*—Finnegan, Henderson, Farabow, Garrett & Dunner, L.L.P.

[57] ABSTRACT

A valve system for an internal combustion engine includes a valve member having a head and a stem extending from the head, the head being capable of forming a seal with a valve seat of the internal combustion engine and the stem having at least one cylinder in an end portion thereof, and a component for contacting a portion of a rocker arm of the engine, the component being movable in the cylinder between a first position and a second position closer to the rocker arm than the first position. Structure is provided for moving the component between the first position and the second position to change lift of the valve member. The system adjusts valve lift according to speed of the engine to improve combustion efficiency.

24 Claims, 2 Drawing Sheets

ENGINE VALVE HAVING ADJUSTABLE LIFT

BACKGROUND OF THE INVENTION

1. Field of the Invention

The present invention relates to a system for adjusting lift of a valve in an internal combustion engine. More particularly, the present invention relates to an apparatus including a rocker arm and a valve member having adjustable lift.

2. Description of Related Art

In a conventional automobile engine, an air-fuel mixture enters a plurality of cylinders and is detonated to reciprocate a plurality of pistons. A crank mechanism transforms the reciprocating motion of the pistons into rotary motion transmitted to the driving wheels of the automobile.

The air-fuel mixture entering the combustion chamber has a great influence on the output of the engine. Various experiments have been performed in an attempt to improve engine output an reduce production of harmful gases through perfect combustion of the air-fuel mixture. For example, combustion efficiency can be improved by adjusting the extent to which an intake or exhaust valve opens (valve lift).

The conventional automobile engine includes a timing belt or chain connecting a crank shaft to a cam shaft, so that rotation of the crank shaft is transmitted to the cam shaft. Cams on the cam shaft pivot rocker arms contacting stems of intake and exhaust valves disposed at each cylinder. When the cam shaft rotates, the pivoting rocker arms open and close the valves according to the profile of the cams to allow for respective intake of the air-fuel mixture and exhaust of combustion byproducts.

The opening and closing system for the conventional automobile engine has a significant drawback. The valve lift (degree to which the valves open to allow flow) is determined by the outer surface profile of the cams and cannot be adjusted. Therefore, the valve lift remains constant during low, medium, and high speeds of the engine. As a result, the conventional engine introduces the same amount of air fuel mixture into the cylinders regardless of the engine speed, making it difficult to optimize combustion efficiency.

In light of the foregoing, there is a need in the art for an improved valve system for an internal combustion engine.

SUMMARY OF THE INVENTION

Accordingly, the present invention is directed to a valve system that substantially obviates one or more of the limitations of the related art. In particular, the present invention adjusts valve lift so that an intake valve can be opened for a relatively longer time during faster engine speeds and opened for a relatively shorter time during slower engine speeds.

To achieve these and other advantages and in accordance with the purpose of the invention, as embodied and broadly described herein, the invention includes a valve system for an internal combustion engine, comprising a valve member having a head and a stem extending from the head, the head being capable of forming a seal with a valve seat of the internal combustion engine and the stem having at least one cylinder in an end portion thereof, a component for contacting a portion of a rocker arm of the engine, the component being movable in the cylinder between a first position and a second position closer to the rocker arm than the first position, and means for moving the component between the first position and the second position to change the lift of the valve member.

In another aspect, the component moves in response to a temperature variation.

In another aspect, the system includes a first conduit placing the cylinder in flow communication with engine exhaust gas to heat the moving means, a second conduit placing the cylinder in flow communication with substantially fresh air to cool the moving means, and a flow controller for controlling flow of the exhaust gas and flow of the substantially fresh air to the cylinder.

In another aspect, the component moves according to the speed of the engine.

In another aspect, the invention includes a valve system comprising a valve system for an internal combustion engine, comprising a rocker arm having first and second portions spaced along a length of the rocker arm, a valve member having a head and a stem extending from the head, the head being capable of forming a seal with a valve seat of the internal combustion engine and the stem having a first cylinder and a second cylinder in an end portion thereof, a first component movable in the first cylinder between a first position contacting the first portion of the rocker arm and a second position out of contact with the first portion, a second component movable in the second cylinder between a first position contacting the second portion of the rocker arm and a second position out of contact with the second portion, first means for moving the first component between the first position of the first component and the second position of the first component, and second means for moving the second component between the first position of the second component and the second position of the second component, the first and second moving means changing lift of the valve member.

In a further aspect, the rocker arm includes a first contact shaft at the first portion of the rocker arm and a second contact shaft at the second portion of the rocker arm, the first shaft contacting the first component and the second shaft contacting the second component, the rocker arm pivoting about an axis of rotation, the first contact shaft being located closer to the axis of rotation than the second contact shaft so that contact of the second contact shaft with the second component lifts the valve member more than contact of the first contact shaft with the first component.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENT

Figure 1:
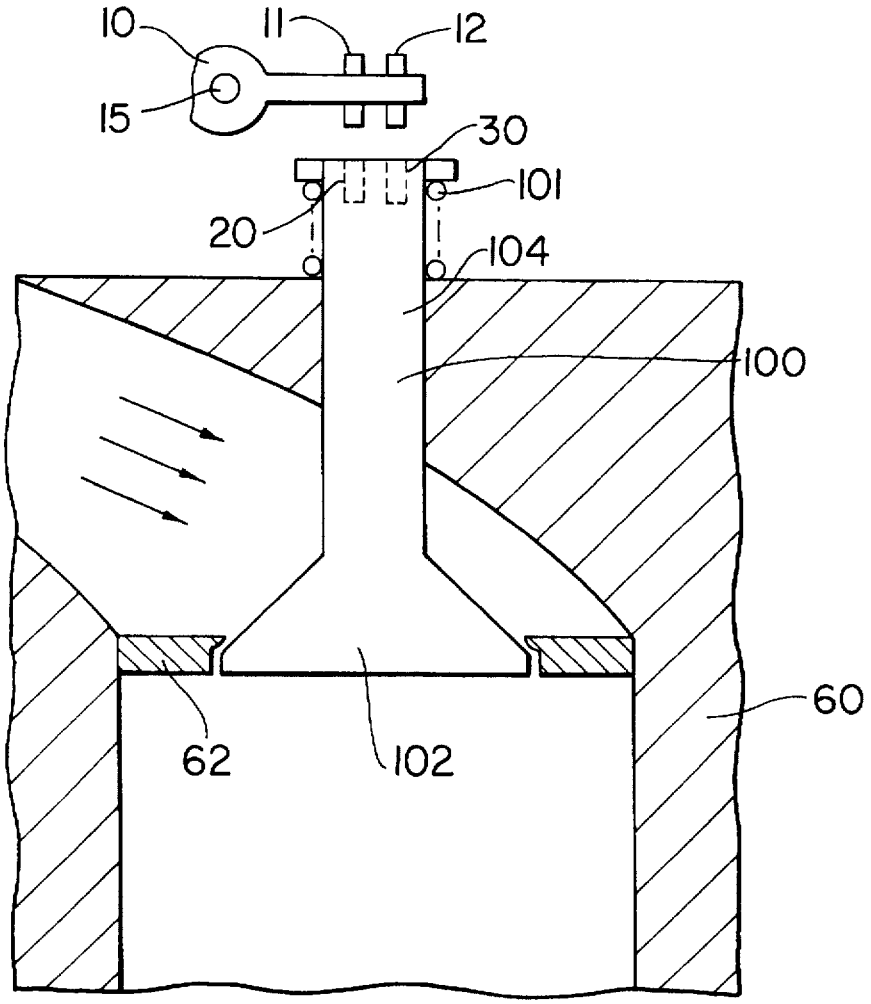
FIG. 1 is a cross-sectional view of an embodiment of the invention installed in a cylinder head of an internal combustion engine.

Reference will now be made in detail to the present preferred embodiment of the invention, an example of which is illustrated in the accompanying drawings. Wherever possible, the same reference numbers are used in the drawings and the description to refer to the same or like parts.

Figure 3:
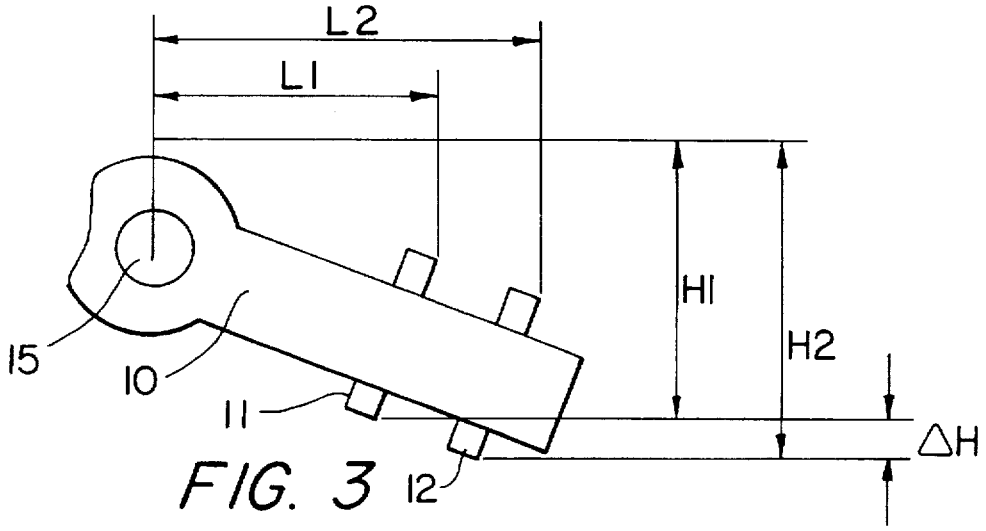
FIG. 3 is a view of a rocker arm shown in FIGS. 1 and 2 including symbols representing spacing of contact shafts on the rocker arm and different lifts for a valve member shown in FIG. 1.
Figure 2:
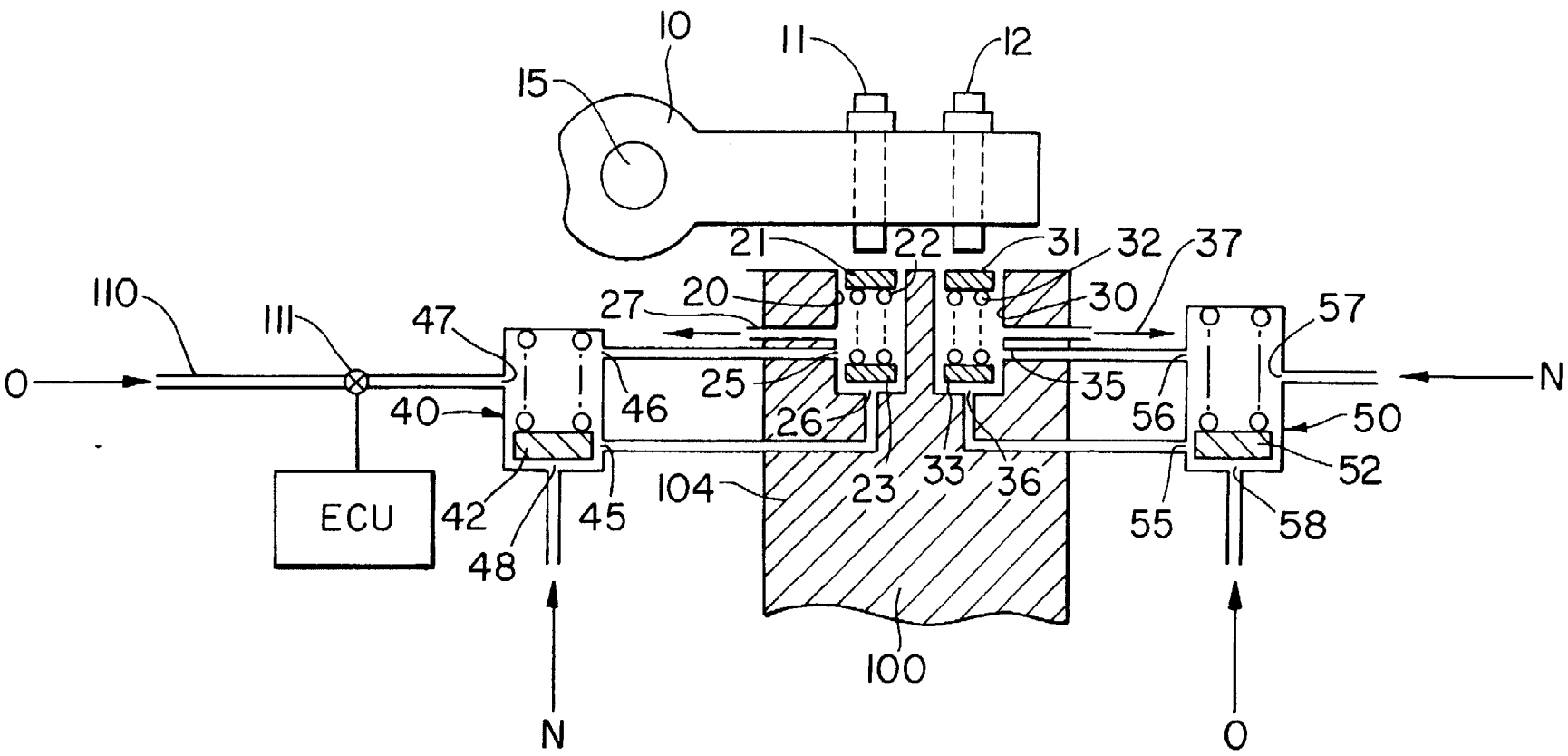
FIG. 2 is a partial cross sectional view showing details of a valve system shown in FIG. 1.

FIG. 1 shows a cylinder head 60 of an internal combustion engine, a rocker arm 10, and a valve member 100. FIG. 2 shows an overall structure of a valve system according to the present invention. FIG. 3 shows the rocker arm 10.

As shown in FIG. 3, the rocker arm 10 pivots about an axis of rotation 15 and includes two parallel contact shafts 11 and 12. The contact shaft 11 is positioned a first distance L1 from the axis of rotation 15 and the contact shaft 12 is positioned at a second distance L2 from axis of rotation 15. The second distance L2 is greater than the first distance L1. As explained below, when the rocker arm 10 pivots about the axis of rotation 15, the valve member 100 lifts (opens) a first lift distance H1, or a second lift distance H2, depending upon the speed of the engine. The second lift distance H2 is greater than the first distance H1 by a difference ΔH.

As shown in FIG. 1, the valve member 100 has a head 102 and a stem 104 extending from the head 102. The head 102 is capable of forming a seal with a valve seat 62 in the cylinder block 60 when the valve member 100 is in a closed position. Preferably, the valve member 100 is positioned in an intake port to act as an intake valve for controlling flow of an air fuel mixture to a cylinder in the cylinder block 60. In the alternative, the valve member 100 may be positioned in an exhaust port to act as an exhaust valve for controlling flow of combustion byproducts from the cylinder.

The valve member 100 has a pair of cylinders 20 and 30 in an end portion of the valve stem 104 under the contact shafts 11 and 12. As shown in FIG. 2, the cylinder 20 contains a movable plate-shaped component 21 and the cylinder 30 contains a movable plate-shaped component 31. As described below, the component 21 is moved toward the rocker arm 10 when the shorter lift distance H1 is desired, and the component 31 is moved toward the rocker arm 10 when the greater lift distance H2 is desired. To open the valve member 100, the rocker arm 10 pivots about the axis of rotation 15 so that the contact shaft 11 contacts the component 21 or the contact shaft 12 contacts the component 31.

The cylinders 20 and 30 are respectively connected to flow controllers 40 and 50. The flow controller 40 has a passage 48 coupled to a conduit for carrying relatively fresh air N from a surge tank (not shown), and a passage 47 coupled to a conduit 110 for carrying exhaust gas O from an exhaust gas manifold (not shown). Similarly, the flow controller 50 has a passage 57 coupled to a conduit for carrying the relatively fresh air N, and a passage 58 coupled to a conduit for carrying the exhaust gas O.

An exhaust gas flow valve 111 is installed in the conduit 110. The exhaust gas flow valve 111 is controlled by an engine control unit (ECU) according to the speed of the engine.

The cylinders 20 and 30, respectively, contain adjustment devices 23 and 33, schematically shown in FIG. 2, for moving the components 21 and 31 toward and away from the rocker arm 10. The cylinders 20 and 30 also include springs 22 and 32, provided between the adjustment devices 23 and 33 and the components 21 and 31, for biasing the components 21 and 31 toward the rocker arm 10. Preferably the adjustment devices 23 and 33 move the components 21 and 31 in response to temperature changes. In one embodiment, the adjustment devices 23 and 33 are expandable chambers containing a substance, such as a gas or liquid, capable of expanding in response to increased temperature, and of contracting in response to reduced temperature. In another embodiment, the adjustment devices 23 and 33 are springs capable of expanding and contracting in response to temperature variations. When one of the adjustment devices 23 or 33 expands to move the respective spring 22 or 32 and component 21 or 31 toward the rocker arm 10, the respective contact shaft 11 or 12 pushes the component 21 or 31 to open the valve member 100.

The cylinder 20 has an exhaust gas inlet port 25 fluidly coupled to an exhaust gas outlet 46 of the flow controller 40 via a conduit, a fresh air inlet port 26 fluidly coupled to a fresh air outlet 45 of the flow controller 40 via a conduit, and an outlet conduit 27 for air or exhaust gas. The cylinder 30 has an exhaust gas inlet port 36 fluidly coupled to an exhaust gas outlet 55 of the flow controller 50 via a conduit, a fresh air inlet port 35 fluidly coupled to a fresh air outlet 56 of the flow controller 50 via a conduit, and an outlet conduit 37 for air or exhaust gas.

Relatively fresh air N from the flow controller 40 enters the cylinder 20 through the fresh air inlet port 26, and warmer engine exhaust gas O from the flow controller 40 enters the cylinder 20 through the exhaust gas inlet port 25. In a similar manner, relatively fresh air N from the flow controller 50 enters the cylinder 30 through the fresh air inlet port 35, and warmer engine exhaust gas O from the flow controller 50 enters the cylinder 30 through the exhaust gas inlet port 36.

The flow controllers 40 and 50 selectively provide either warm exhaust gas or cooler fresh air to the cylinders 20 and 30. When exhaust gas enters one of the cylinders 20 or 30, the respective adjustment device 23 or 33 expands to move the respective component 21 or 31 and spring 22 or 32 toward the rocker arm 10. In contrast, when relatively fresh air enters one of the cylinders 20 or 30, the respective adjustment device 23 or 33 contracts to move the respective component 21 or 31 and spring 22 or 32 away from the rocker arm 10.

At a relatively low speed of the engine, the ECU causes the exhaust gas flow valve 111 in the conduit 110 to open so that the exhaust gas O is introduced into the flow controller 40 through the passage 47. The relatively hot exhaust gas O passes over a flow adjustment device 42 similar to the adjustment devices 23 and 33 and then flows out of the exhaust gas outlet 46. The exhaust gas O flows into the cylinder 20 via the exhaust gas inlet port 25 and transfers heat to the adjustment device 23. When the temperature of the adjustment device 23 increases, the adjustment device 23 moves the spring 22 and the component 21 toward the rocker arm 10. During an intake stroke of the engine, the contact shaft 11 of the rocker arm 10 contacts the component 21 to open the valve member 100 by the lift distance H1.

The flow controller 50 includes a flow adjustment device 52 similar to the flow adjustment device 42. The flow adjustment device 52 contracts to provide flow of the cooler, relatively fresh air N to the cylinder 30 and prevent flow of exhaust gas O to the cylinder 30 when the hot exhaust gas flows into the cylinder 20. The cooler fresh air entering the cylinder 30 lowers the temperature of the adjustment device 33, thereby causing the adjustment device 33 to contract and move both the spring 32 and the component 31 away from the rocker arm 10. In this position, the contact shaft 12 does not contact the component 31 during the intake stroke of the engine.

In this manner, the contact shaft 11 contacts the component 21 to open the valve member 100 by the relatively short lift distance H1 during slower speed of the engine.

At higher speeds of the engine, the ECU controls the exhaust gas flow valve 111 to prevent flow of the exhaust gas O through the conduit 110. Relatively fresh air N flows through passage 48 into the flow controller 20. The cooler fresh air N causes the flow adjustment device 42 to contract so that the fresh air N is introduced into the cylinder 20 via the fresh air outlet 45 and fresh air inlet 25. The cooler fresh air N flowing into the cylinder 20 causes the adjustment device 23 to contract and thereby move the spring 22 and component 21 away from the rocker arm 10. Therefore, the contact shaft 11 does not come into contact with the component 21 during an intake stroke of the engine.

When the cooler fresh air N flows into the cylinder 20, the flow controller 50 causes relatively warmer exhaust gas O to flow into the cylinder 30. In response to increased temperature, the adjustment device 33 expands to move the spring 32 and component 31 towards the rocker arm 10. This allows the contact shaft 12 to contact the component 31 during an intake stroke of the engine so that the valve member 100 is lifted by the greater distance H2 and opened for a relatively greater amount of time.

The contact shaft 11 of the rocker arm 10 pushes the component 21 to open the valve member 100 during lower speeds of the engine. The contact shaft 12 of the rocker arm 10 pushes the component 31 to open the valve member 100 during higher speeds of the engine. When the contact shaft 11 opens the valve member 100, the valve member 100 has a shorter lift H1 and opens for a shorter period of time. When the contact shaft 12 opens the valve member 100, the valve member 100 has a greater lift H2 and opens for a longer period of time.

This structure allows for optimal adjustment of the amount of air fuel mixture flowing to a cylinder of an engine by changing the opening of an intake valve according to speed of the engine. Adjusting the intake of the air fuel mixture according to engine speed improves both combustion efficiency and output of the engine.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A valve system for an internal combustion engine, comprising:

a valve member having a head and a stem extending from the head, the head being capable of forming a seal with a valve seat of the internal combustion engine and the stem having at least one cylinder in an end portion thereof;

a component for contacting a portion of a rocker arm of the engine, the component being movable in the cylinder between a first position and a second position closer to the rocker arm than the first position; and means for moving the component between the first position and the second position to change lift of the valve member.

2. The valve system of claim 1, wherein the moving means moves the component in response to a temperature variation.

3. The valve system of claim 2, wherein the moving means includes a spring biasing the component toward the rocker arm.

4. The valve system of claim 2, further comprising a first conduit placing the cylinder in flow communication with engine exhaust gas to heat the moving means.

5. The valve system of claim 4, further comprising a second conduit placing the cylinder in flow communication with substantially fresh air to cool the moving means.

6. The valve system of claim 5, further comprising a flow controller for controlling flow of the exhaust gas and flow of the substantially fresh air to the cylinder.

7. The valve system of claim 6, wherein the flow controller includes means for varying flow of the exhaust gas and flow of the substantially fresh air in response to temperature variation.

8. The valve system of claim 5, further comprising an exhaust gas flow valve for regulating flow of the exhaust gas to the cylinder and a control unit for controlling the exhaust gas flow valve according to the speed of the engine.

9. The valve system of claim 2, wherein the moving means is an expandable chamber containing a substance capable of changing size in response to a temperature variation.

10. The valve system of claim 2, wherein the moving means includes a spring capable of changing size in response to a temperature variation.

11. The valve system of claim 1, further comprising means for controlling the moving means according to the speed of the engine.

12. A valve system for an internal combustion engine, comprising:

a rocker arm having first and second portions spaced along a length of the rocker arm;

a valve member having a head and a stem extending from the head, the head being capable of forming a seal with a valve seat of the internal combustion engine and the stem having a first cylinder and a second cylinder in an end portion thereof;

a first component movable in the first cylinder between a first position contacting the first portion of the rocker arm and a second position out of contact with the first portion;

a second component movable in the second cylinder between a first position contacting the second portion of the rocker arm and a second position out of contact with the second portion;

first means for moving the first component between the first position of the first component and the second position of the first component; and second means for moving the second component between the first position of the second component and the second position of the second component, the first and second moving means changing lift of the valve member.

13. The valve system of claim 12, wherein the first moving means moves the first component in response to a first temperature variation, and the second moving means moves the second component in response to a second temperature variation.

14. The valve system of claim 13, wherein the first moving means includes a first spring biasing the first component toward the rocker arm, and the second moving means includes a second spring biasing the second component toward the rocker arm.

15. The valve system of claim 13, further comprising a first conduit placing the first cylinder in flow communication with engine exhaust gas to heat the first moving means, and a second conduit placing the second cylinder in flow communication with the engine exhaust gas to heat the second moving means.

16. The valve system of claim 15, comprising a third conduit placing the first cylinder in flow communication with substantially fresh air to cool the first moving means, and a fourth conduit placing the second cylinder in flow communication with the substantially fresh air to cool the second moving means.

17. The valve system of claim 16, further comprising a first flow controller for controlling flow of the exhaust gas and flow of the substantially fresh air to the first cylinder, and a second flow controller for controlling flow of the exhaust gas and flow of the substantially fresh air to the second cylinder.

18. The valve system of claim 17, wherein the first flow controller includes means for varying flow of the exhaust gas and flow of the substantially fresh air in response to a first temperature variation, and the second flow controller includes means for varying flow of the exhaust gas and flow of the substantially fresh air in response to a second temperature variation.

19. The valve system of claim 18, further comprising an exhaust gas flow valve for regulating flow of the exhaust gas to the first flow controller and a control unit for controlling the exhaust gas flow valve according to the speed of the engine.

20. The valve system of claim 13, wherein the first moving means includes a first expandable chamber containing a substance capable of changing size in response to a first temperature variation, and the second moving means includes a second expandable chamber containing a substance capable of changing size in response to a second temperature variation.

21. The valve system of claim 13, wherein the first moving means includes a first spring capable of changing size in response to a first temperature variation, and the second moving means includes a second spring capable of changing size in response to a second temperature variation.

22. The valve system of claim 12, further comprising means for controlling the first and second moving means according to the speed of the engine.

23. The valve system of claim 12, wherein the rocker arm includes a first contact shaft at the first portion of the rocker arm and a second contact shaft at the second portion of the rocker arm, the first shaft contacting the first component and the second shaft contacting the second component.

24. The valve system of claim 23, wherein the rocker arm pivots about an axis of rotation, the first contact shaft being located closer to the axis of rotation than the second contact shaft so that contact of the second contact shaft with the second component lifts the valve member more than contact of the first contact shaft with the first component.

* * * * *